US005683218A

United States Patent [19]

Mori

[11] Patent Number: 5,683,218

[45] Date of Patent: Nov. 4, 1997

[54] JIG FOR PERFORATING PAPER SHEETS AND BINDING THOSE ON A RING BINDER

[75] Inventor: Chuzo Mori, Tokyo, Japan

[73] Assignee: Carl Manufacturing Co., Ltd., Tokyo, Japan

[21] Appl. No.: 503,005

[22] Filed: Jul. 17, 1995

[30] Foreign Application Priority Data

Jul. 22, 1994 [JP] Japan ..... 6-191809

[51] Int. Cl.[6] ..... B42B 9/00

[52] U.S. Cl. ..... 412/40; 412/33; 412/16

[58] Field of Search ..... 412/40, 16, 38, 412/39, 33, 34

[56] References Cited

U.S. PATENT DOCUMENTS

| | | | |
|---|---|---|---|
| 3,060,780 | 10/1962 | Stuckens | 412/40 X |
| 3,699,596 | 10/1972 | Lyon | 412/40 X |
| 4,509,397 | 4/1985 | Mori et al. . | |
| 4,613,266 | 9/1986 | Scharer | 412/40 |
| 4,645,399 | 2/1987 | Scharer | 412/16 |
| 4,872,796 | 10/1989 | Hsieh et al. | 412/16 |
| 5,007,782 | 4/1991 | Groswith, III et al. | 412/40 |
| 5,143,502 | 9/1992 | Kaufmann et al. | 412/16 |
| 5,183,361 | 2/1993 | Ho | 412/16 |
| 5,273,387 | 12/1993 | Groswith, III et al. | 412/40 |
| 5,431,519 | 7/1995 | Baumann | 412/40 |

*Primary Examiner*—Frances Han
*Attorney, Agent, or Firm*—Oliff & Berridge

[57] ABSTRACT

A jig for perforating paper sheets and for binding said paper sheets perforated on a ring binder is provided. For perforating, paper sheets retaining plate 21 attached pivotally to the guide portion 20 is opened, the surface of the paper sheets positioning portion 28 and the surface of the paper sheets placing portion is flush with each other by locating the former adjacent to the front edge 36 of the latter and paper sheets to be perforated are positioned, thereafter, the paper sheet retaining plate is closed to clamp the paper sheets and the paper sheets positioning portion is turned to protrude the paper sheets from the front edge 36 of the paper sheets placing portion 19 for perforating. For binding the paper sheets perforated, by opening and closing the paper sheets retaining plate 21 which is connected to the movable plate slidable beneath the paper sheets placing portion 19, the ring bars planted on the rear end of the paper placing portion and the L-ring bars provided on the movable plate come close and distant to open the rings set on the rings bars and insert the rings into the perforations of the paper sheets.

1 Claim, 12 Drawing Sheets

JIG FOR PERFORATING PAPER SHEETS AND BINDING THOSE ON A RING BINDER

BACKGROUND OF THE INVENTION

1. Field of the Invention

The present invention relates to an improvement of the jig for perforating paper sheets to be bound in a binder and binding those in a ring binder. In more detail, said jig of the present invention comprises a function to perforate paper sheets to be bound in a ring binder and a function to bind the paper sheets perforated in a ring binder.

2. Prior Art

A binder as a loose leaf binder, which is molded integrally with a resin having elasticity and comprises a plurality of rings extended from one side edge of a longitudinal base plate at a given regular spacing, each of rings has a given width and forms a ring having a given curvature in such a manner as each tip end thereof is overlapped said base plate (hereinafter referred to "ring binder"), is known. How to bind paper sheets perforated using such ring binder is shown in FIG. 16 as a prior art, in which papers 1 having rectangular holes 3 perforated in advance at the same spacing to the one of the rings 4 of said ring binder 2 are inserted by the rings of said ring binder respectively, for which a jig for perforating papers 1 in a form of rectangular aperture adapted to accept the width of the ring 4 and a jig for opening a plurality of rings 4 at a time are needed.

A conventional perforator comprising a punch and a perforation jig which is made use in the present invention is explained first. Such perforator is introduced in a U.S. Pat. No. 4,509,397 of the same inventor, in which said perforator comprises a punch and a perforation jig comprising upper and lower oblong sheet retainer plates adapted to hold paper sheets, so that in the course of perforation, the perforation jig will retain the punch fast in position with respect the paper sheets and prevent the punch from being shaken in the vertical direction relative to the perforation jig. Said preforator is constructed so that when the front portion of the punch is abutted against the upper sheet retainer plate forming part of the perforation jig, a punch-supporting member of the lower sheet retainer plate protruding outwardly from the upper sheet retainer plate advances into a recess extended from the front side to the rear side of the punch adapted to receive insertion of paper sheets and, consequently, the perforation jig is allowed to hold the punch safely.

More in detail, as shown in FIG. 17, to one end of a lower sheet retainer plate 11 is attached pivotally an upper sheet retainer plate 12, on said upper sheet retainer plate 12 a punch guide portion 14 having a plurality of punch positioning depressions 15, into which a positioning projection (not-shown) of a punch is engaged, is provided integrally. Further, the lower sheet retainer plate 11 comprises a sheet placing portion 13, to the front edge of which a sheet positioning member 16 is located adjacently in such a manner as it is attached pivotally and rotatably in the direction of arrow at both ends thereof to the lower sheet retaining plate 11, and the upper surface thereof is located on the same level as the one of the sheet placing portion 13. 16 designates a raised edge to which the ends of the paper sheets inserted in the direction B are abutted to determine the paper sheet position.

In the operation of the jig for perforation thus constructed, the paper sheets retaining plate 12 is opened, the paper sheets to be perforated are inserted in the direction B, the ends of the paper sheets are abutted against the raised edge 17, the paper sheets retaining plate 12 is closed to hold the paper sheets and the sheet positioning member 16 is turned in the direction of arrow A, so that the ends of the paper sheets are protruded from the edge 11' of the paper sheet placing portion of the paper sheet retaining plate 11.

While receiving insertion of the paper sheets in the recess of a punch (not-shown) together with the punch supporting member, a punch position determining projection is engaged with the punch positioning depressions 15 and the paper sheets are punched to obtain 6 holes for instance and the punch moves laterally and engages with the adjacent depression, which makes another 6 holes, and, thus, by 5 times series of replacement of the engagement with the depression the number of holes becomes 30 in total spaced regularly.

FIG. 18 shows an example of a known device by which paper sheets are perforated and a binder is opened for binding thus perforated paper sheets. In more detail, papers P are inserted in a slit 7 between a punch 5 and a base 6, and by one push-down movement of a handle 8 the necessary number of perforation having oblique aperture and spacing corresponding to the rings of a ring binder are provided on the paper sheets. Subsequently, a cover 9 is opened to expose a ring opening jig for setting a ring binder. Then, by turning a knob 10 the rings of said ring binder are opened and held for allowing said rings to be inserted into the apertures of said paper sheets.

Such conventional device as shown in FIG. 18 has been widely used and quite effective when used in a workshop broader, but on the other hand when used in a narrow space such as a home it is too large to use it due to the punch portion 5 and the handle 8 or to keep at the time of not-using it.

Accordingly, the object of the present invention is to provide jigs for perforating paper sheets and binding those in a ring binder which has a function for use of jig for perforating not only round but also square apertures and a function for use of jig for opening a ring binder for binding papers.

SUMMARY OF THE INVENTION

According to the present invention, a miniturized jig which comprises a function for perforating paper sheets apertures for a plastic made ring binder and a function for opening a ring binder for binding said perforated paper sheets is obtained with the following structures.

Said jig comprises;

paper sheets placing portion having a stepped portion of L-letter in section on the rear end thereof, a pair of box type of guide portions provided in parallel on both sides of said paper sheet placing portion, paper sheets positioning portion attached pivotally to both of upper ends of said pair of guide portions and at its non-rotated position locating adjacent to the front edge of said paper sheets placing portion, paper sheets retaining plate attached pivotally to both ends of said guide portions located at the front edge side of the paper sheets placing portion, a punch guide portion provided integrally with said paper sheets retaining plate having an edge in parallel with said front edge and being provided with punch positioning recesses thereon which are exposed when said paper sheets retaining plate is closed onto the paper sheets placing portion in such a manner as said edge is protruded, plural number of ring bars lined at regular spacing on said stepped portion, a movable plate disposed slidably beneath said stepped portion and provided with sliders on both ends thereof integrally which are guided in the guide portion, links connecting said sliders to the paper sheets retaining plate, and L-ring bars provided on the front edge of said movable plate in such a manner as those are lined in parallel with said ring bars at the same spacing with rings of a ring binder, and each with its tip end bent horizontally in the direction perpendicular to the sliding direction of the movable plate, wherein paper sheets retaining plate is opened, and paper sheets positioned by the paper sheets positioning portion are enabled to be perforated with a punch along the punch guide portion by protruding said sheets from the front edge due to turning downward said paper positioning portion, and after perforating, by opening said paper sheets retaining plate said ring bars and said L-ring bars come close, which enables a ring binder to be set on and by closing said paper sheets retaining plate said ring binder is opened to enable said rings to insert the perforated holes of the paper sheets.

In the present invention thus formed, the operation thereof is as follows.

First, for perforation of paper sheets the paper sheets retaining plate, which is attached pivotally to the end of the front edge of the paper sheets placing plate, is raised and the paper sheets to be perforated are positioned by abutting the ends of said paper sheets against the paper sheets positioning portion which is attached pivotally to the front edge of the guide portion of the paper sheets placing plate in such a manner as it becomes a flat surface together with the upper surface of the paper sheets placing plate.

After positioning the paper sheets, by closing the paper sheets retaining plate said paper sheets are gripped between the paper sheets retaining plate and the paper sheets placing plate. Subsequently, by turning the paper sheets positioning portion the paper sheets positioned are protruded from the front edge of the paper sheets placing portion, which enables for the punch to perforate the paper sheets.

Next, the binding process of the paper sheets perforated is explained. Since the paper sheets retaining plate is connected by a pair of links with the sliders provided on both sides of the movable plate, by opening an closing of the paper sheets retaining plate the L-ring bars provided on the movable plate come close to the ring bars and come distant from them respectively. By opening the paper sheets retaining plate the ring bars and the L-ring bars come close, then the base plate of a ring binder is inserted between the vertical wall of the stepped portion and the rings and by shifting the ring binder laterally in order to insert the horizontal tip of the L-ring into the rings. Subsequently, by closing the paper sheets retaining plate the L-ring bars come distant, thereby the rings are opened due to hooking of the tip of the L-rings. In order to set the ring bars for the above operation, it is necessary that the spacing between the horizontal tip end of the L-ring and the vertical pole of the adjacent L-ring bar is wider than the width size of the ring of the ring binder.

Since the the paper sheets retaining plate in the present invention is connected to the slider by the links, it has two functions in which gripping paper sheets and displacing L-ring bars are carried out.

From the invention thus constructed, the following effects are expected. That is, since the paper sheets positioning portion (perforation side) is provided on the front edge of the paper sheets placing portion and the ring bars (ring opening side) are on the stepped portion of the rear side of the paper sheets placing portion, the perforation side (front side) and the opening side (rear side) interposing the paper sheets placing plate are located in a level, the whole height is lowered, and since the paper retaining plate is attached pivotally on the upper end of the guide portion which is provided on both sides of the paper sheets placing plate, the slider is guided by this guide portion and both are connected by links, the whole structure can be simplified.

BRIEF EXPLANATION OF THE PREFERRED EMBODIMENT

PREFERRED EMBODIMENT OF THE INVENTION

Figure 14:
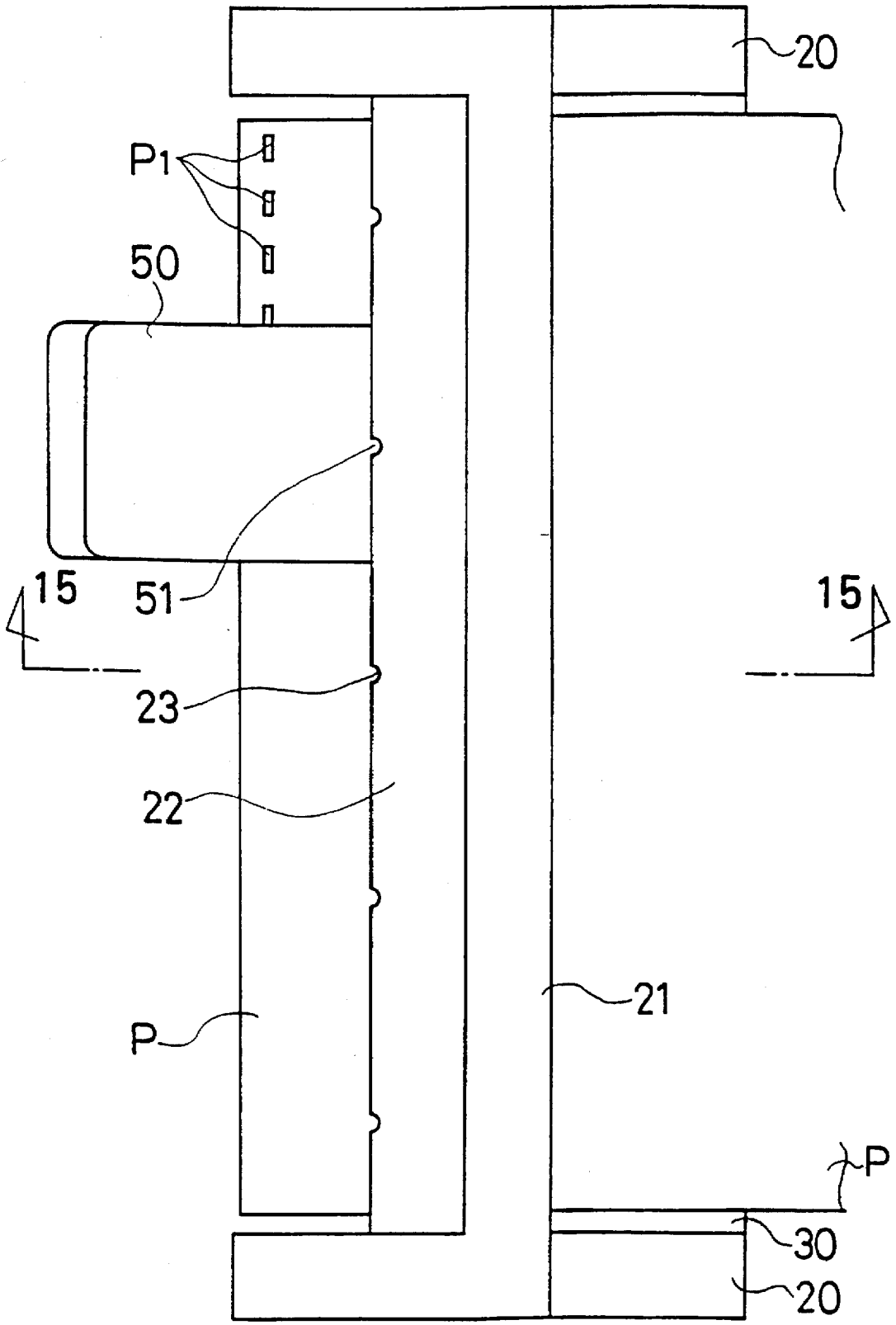
FIG. 14 is a plan view in which a status wherein perforation is carried out with a punch is shown.

Hereinafter, an embodiment of the present invention will be explained. First, referring to FIG. 3 an outline of the present invention is explained. In figure, box-like guide portions 20 are provided on both sides of a paper sheets placing plate 19, and on the left and right side edges of the top of each guide portion 20 the paper retaining plate 21 is attached pivotally. Further, as shown in FIG. 14, on the paper sheets retaining plate 21 is provided integrally with a punch guide plate 22 having plurality of recesses 23 for positioning the punch for perforation. At the rear of the paper sheets placing plate 19, a stepped portion 24 having L-letter in section is provided, on said stepped portion 24 are planted ring bars 25 at a regular spacing.

Beneath the stepped portion 24 a movable plate 26 is located slidably in contact therewith, on the front edge of which L-ring bars 27 having horizontally bent tips are provided at the same spacing as the bar rings. Further, a paper sheets positioning portion 28 provided with a raised portion 29, against which the paper sheets to be perforated abut, are attached pivotally to the guide portion 20.

The numeral 30 designates a cover which is attached pivotally to the guide portion 20 and covers the ring bars 25 and L-ring bars 27. Further, the cover 30 is provided with holes 31 into which tips of the ring bars 25 are inserted. The numeral 32 designates links to connect the paper sheets retaining plate 21 to later-described sliders 33.

Figure 3:
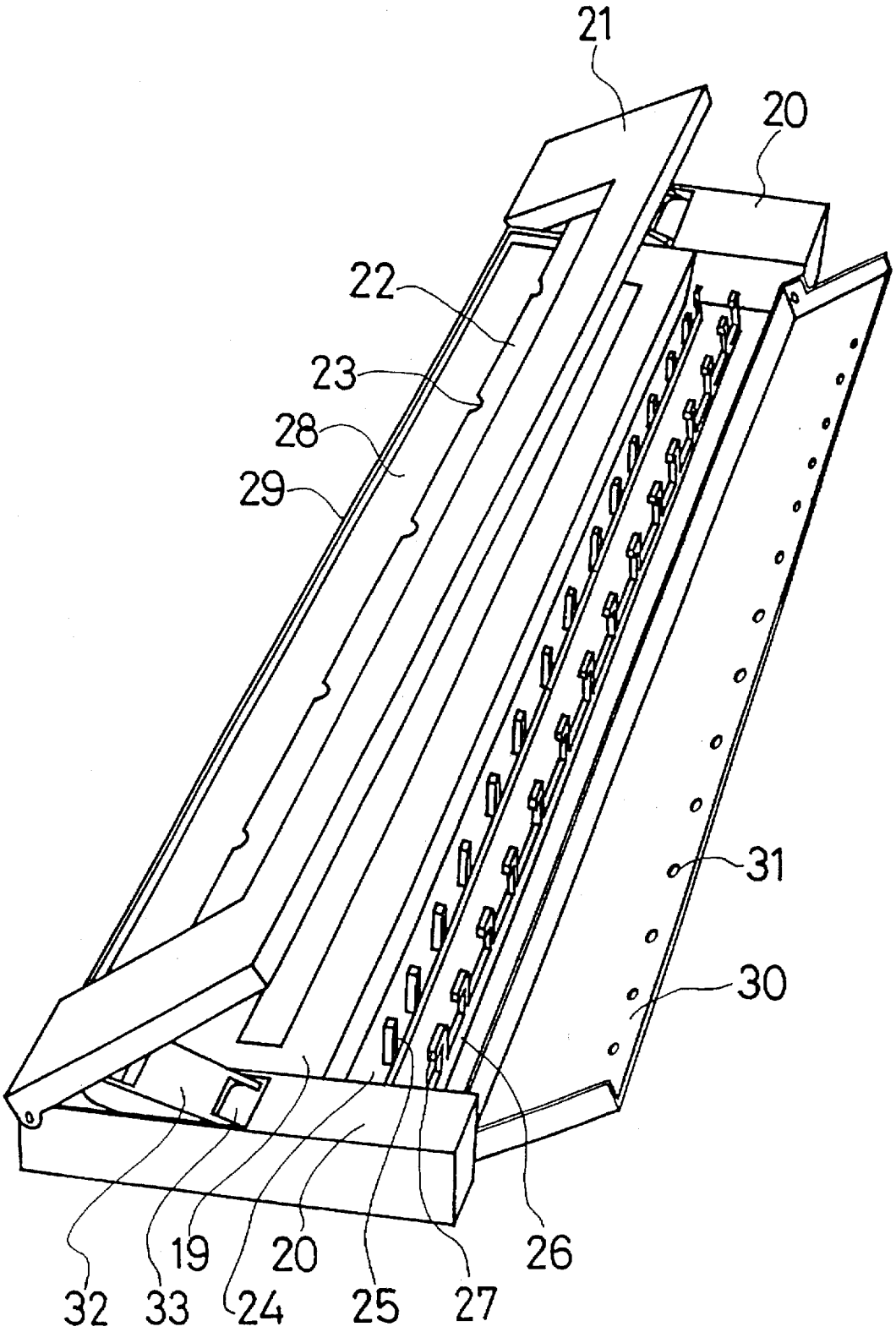
FIG. 3 is a perspective view of an embodiment of the present invention.
Figure 4:
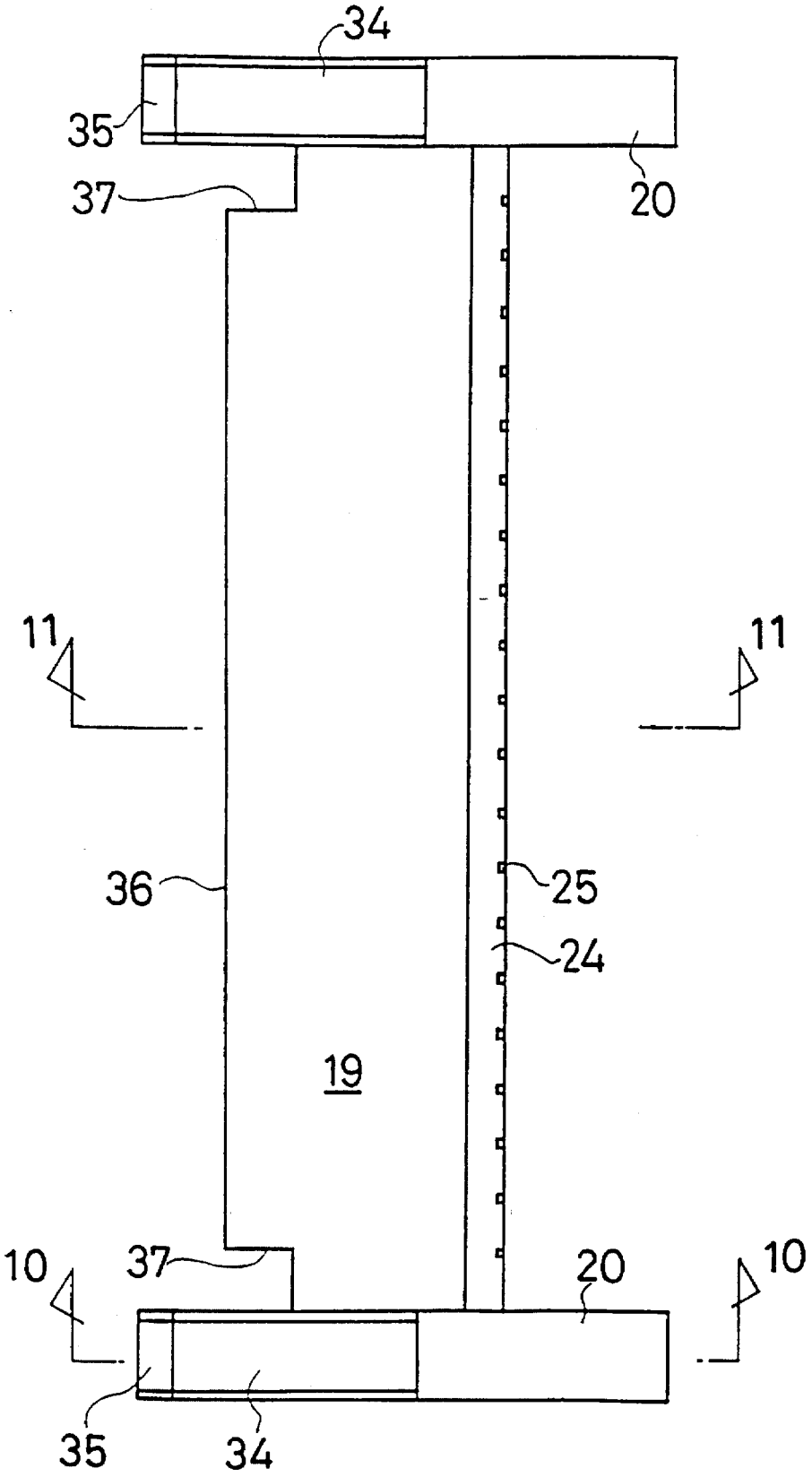
FIG. 4 is a plan view of the paper sheets placing plate of FIG. 2.

Hereinafter, each portion is explained in more detail. FIG. 4 is a plan view of the paper sheets placing portion 19 provided with the guide portion 20 on both ends thereof, which are integral with the paper sheets placing portion 19. The guide portion 20 are box-like configured in cross-section, one part of the upper surface of each guide portion is opened as an upper opening 34, into which, as shown in FIG. 3 a link 32 is adapted to be inserted. And on the end of each guide portion 20 (on the front edge side of the paper sheets placing portion), a pivot 35 is provided and the paper sheets retaining plate 21 is attached thereto pivotally. As shown in FIG. 4, on both ends of the front edge 36 of the paper sheets placing portion 19 there are provided cut-out portions 37 which form slit between the guide portion 26 into which later-described paper positioning portion 28 are adapted to be attached pivotally.

Figure 10:
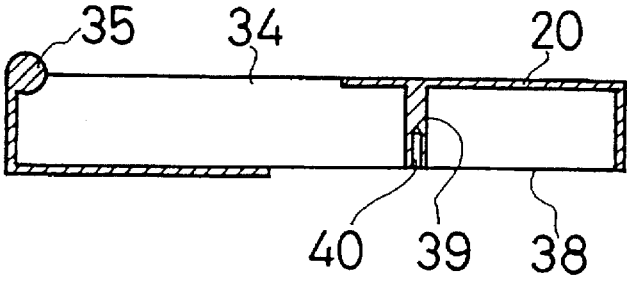
FIG. 10 is a vertical cross-sectional view along with 10—10 of FIG. 4.
Figure 11:
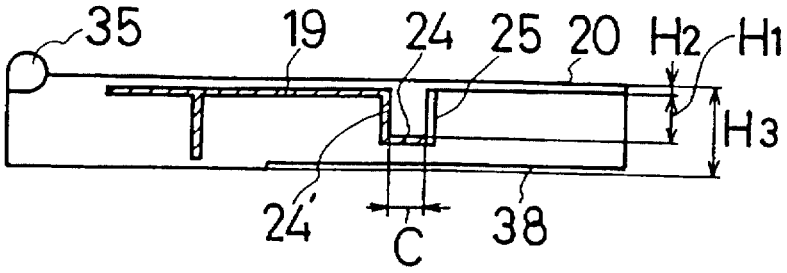
FIG. 11 is a vertical cross-sectional view along with 11—11 of FIG. 4.
Figure 12:
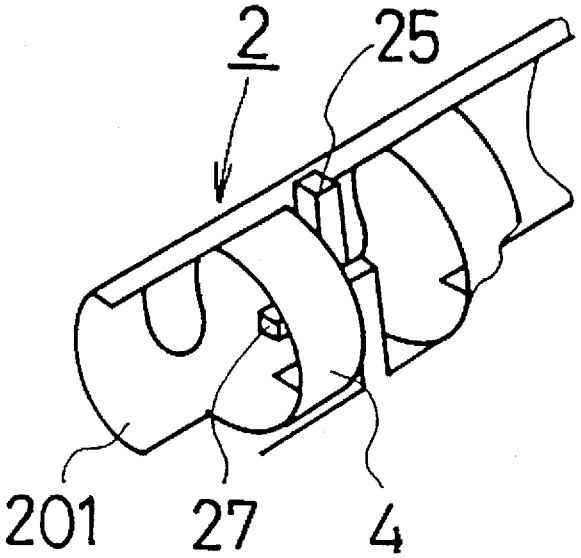
FIG. 12 is a perspective view showing the relationship between rings, ring bars and L-ring bars.

In FIG. 10 shown in cross-section along with 10—10 line of FIG. 4, the bottom of the guide portion 20 is provided with opening 38 and later-described slider 33 provided on both ends of a movable plate 26 are adapted to be inserted therethrough. The provision of the upper opening 34 and the bottom opening 38 enables the assembly of the link 32 and the slider 33 easier. This bottom opening 38 is closed with a bottom plate 45, and for that purpose a pin 39 provided with a tapped hole 40, into which a bottom plate fixing screw is fixed, is planted on the back surface of the guide portion 20. The slider 33 is guided and slides on the bottom plate 45. Next, in FIG. 11 shown in cross-section along line 11—11 of FIG. 4, the spacing C between the vertical wall surface 24' located at the stepped portion 24 and the ring bars 25 are adapted to be the size into which the base plate 201 of the ring binder 2 can be inserted. And, although the height of H1 of the ring bar 25 is about same as the height of the surface of the paper placing portion 19, wherein it is important that the height of the ring bars 25 is adapted to be as high as possible for avoiding to disturb the smooth setting of the paper sheets to be perforated and for applying to all sizes of diameter of ring 4 (FIG. 12).

Figure 5:
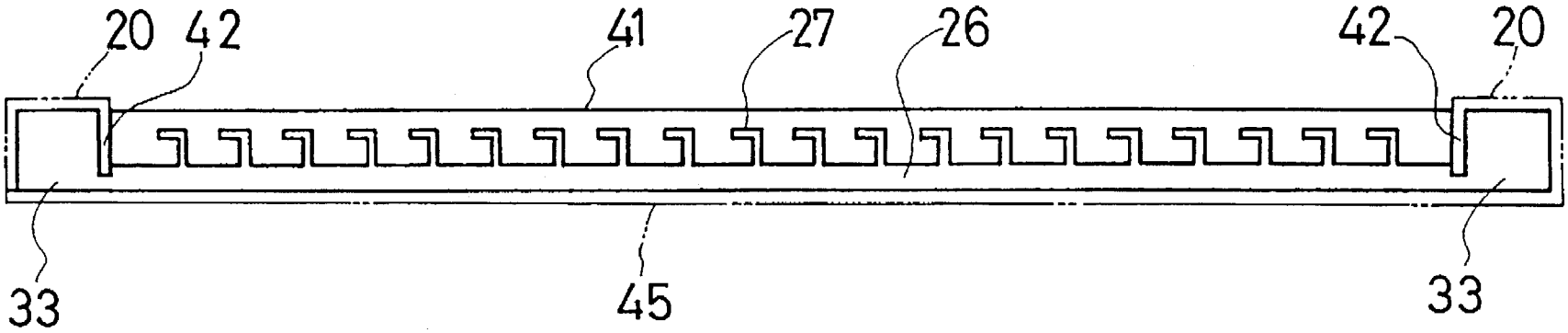
FIG. 5 is a front view of the movable plate of FIG. 2.
Figure 6:
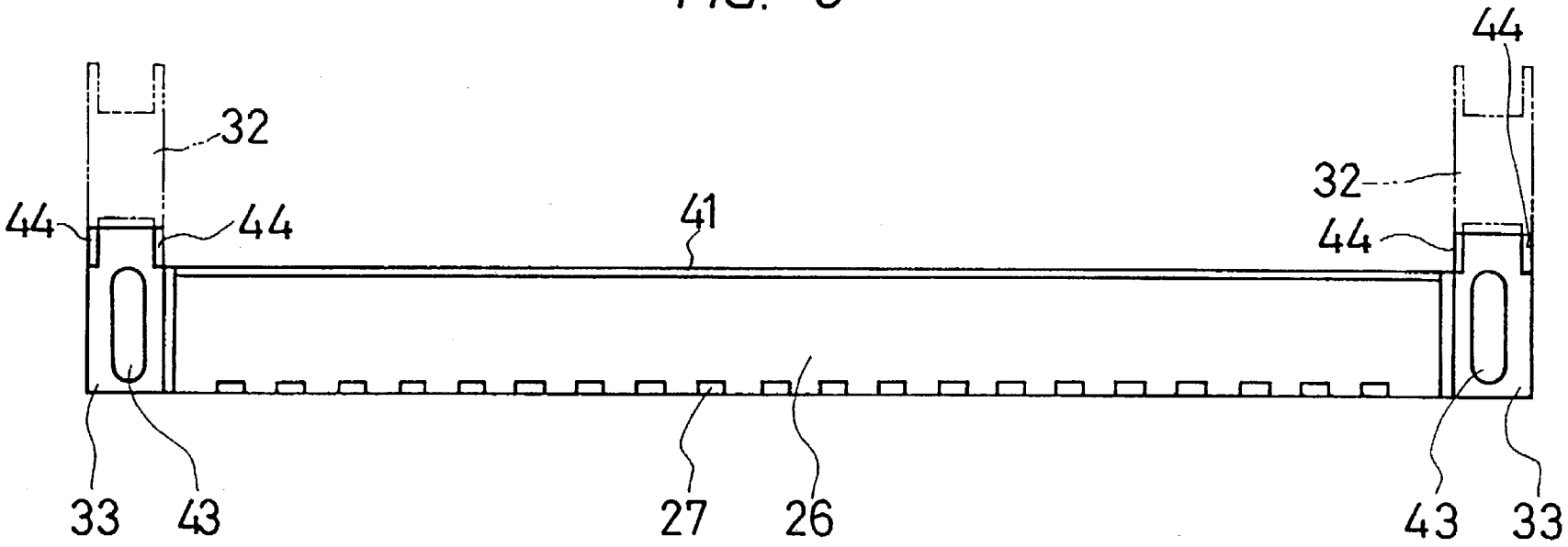
FIG. 6 is a plan view of FIG. 5.

Next, a movable plate 26 provided with L-ring bars is explained. FIG. 5 shows a front view of the movable plate 26, on the front edge thereof the L-ring bars 27 having tip ends bent in one direction horizontally are planted at a given regular spacing corresponding to the ring bars 25, as shown in FIG. 6 showing a plan view. And, on both ends of the movable plate 26 are provided with the sliders 33 integrally. And, at the rear edge of the movable plate 26 a rear wall 41 is raised and between said wall 41 and the side of the slider 33 a gap 42, in which the side wall of the guide portion 20 is guided, is provided. Further, the slider 33 is, as shown in FIG. 6, provided with a longitudinal opening 43 pierced vertically, through which the pin 39 of FIG. 10 is inserted, and on one side end of the slider 33 a stepped-connection portion 44 is provided, and when the link is attached thereto, the side surface of the link and the side surface of the slider 33 other than the stepped-connection portion becomes a continuous plane to slide on the inner surface of the guide portion 20. And the back surface of the movable plate 26 slides on the bottom plate 45.

Figure 1:
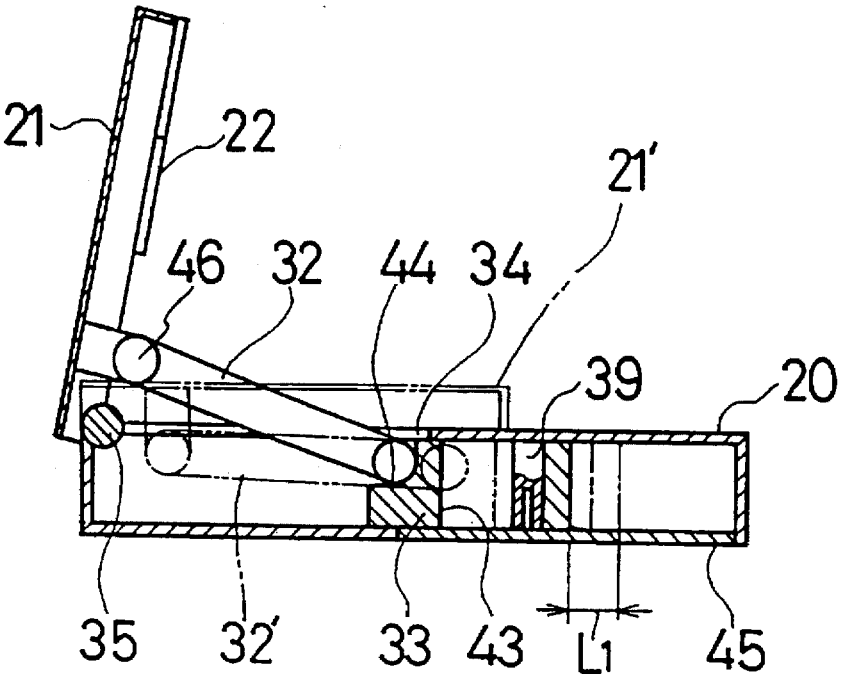
FIG. 1 shows an embodiment of the present invention in which a cross-sectional view at the guide portion wherein the paper sheets retaining plate and the slider are connected.
Figure 2:
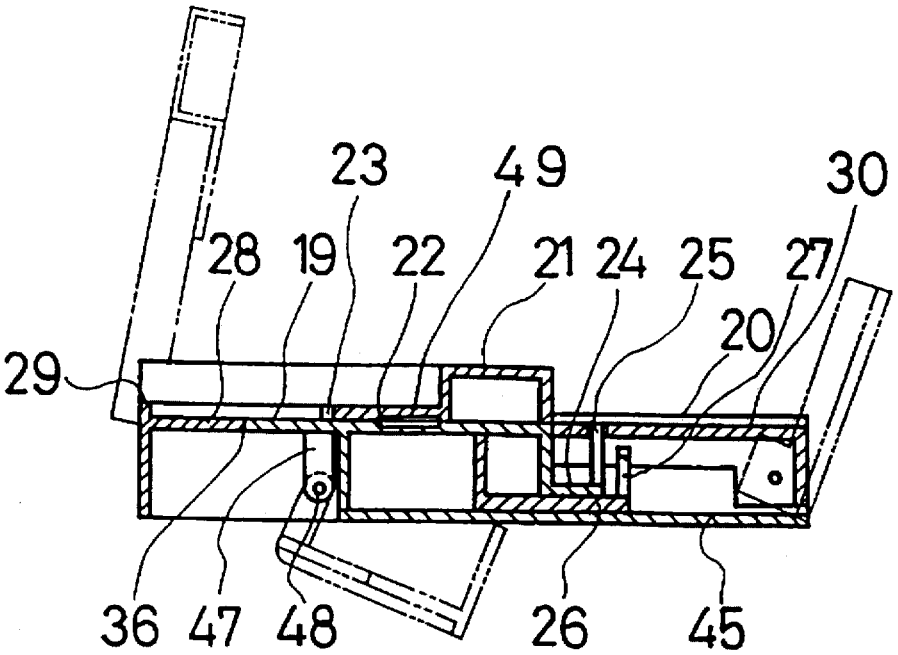
FIG. 2 is a cross-sectional view of the paper sheets placing portion.

FIG. 1 is a cross-sectional view showing the status in which the paper sheets retaining plate 21 and the movable plate 26 are assembled to the guide portion 20 in such a manner as the slider 33 is assembled through the opening 38 in the guide portion 20 while inserting the pin 39 through the longitudinal opening 43, and the rink 32 is attached to the stepped-connection portion 44. On the other hand, the other end of the rink 32 is connected to a connecting portion 46 provided on the back side of the paper retaining plate 21 and the base portion of the paper sheets retaining plate 21 is attached to the pivot 35 pivotally. And, finally, the bottom plate 45 is fixed to the pin 39 by screwing a screw into the tapped hole 40. Thereby, when the paper sheets retaining plate 21 is closed in the position 21', the rink 32 is displaced to the approximately horizontal position 32' to cause the slider 33 to move by the distance L1. Accordingly, it is a matter of course that the movable plate can displace, and FIG. 2 shows in cross-section the position thereof after the displacement. Whereby, the slider 33 moves inside the guide portion 20 by being guided along the inner surfaces of the ceiling and the side wall of the guide portion 20 and on the upper surface of the movable plate 26. By this displacement of the slider 33 the L-ring bars 27 come close to the ring bars 25 or come away therefrom.

Figure 7:
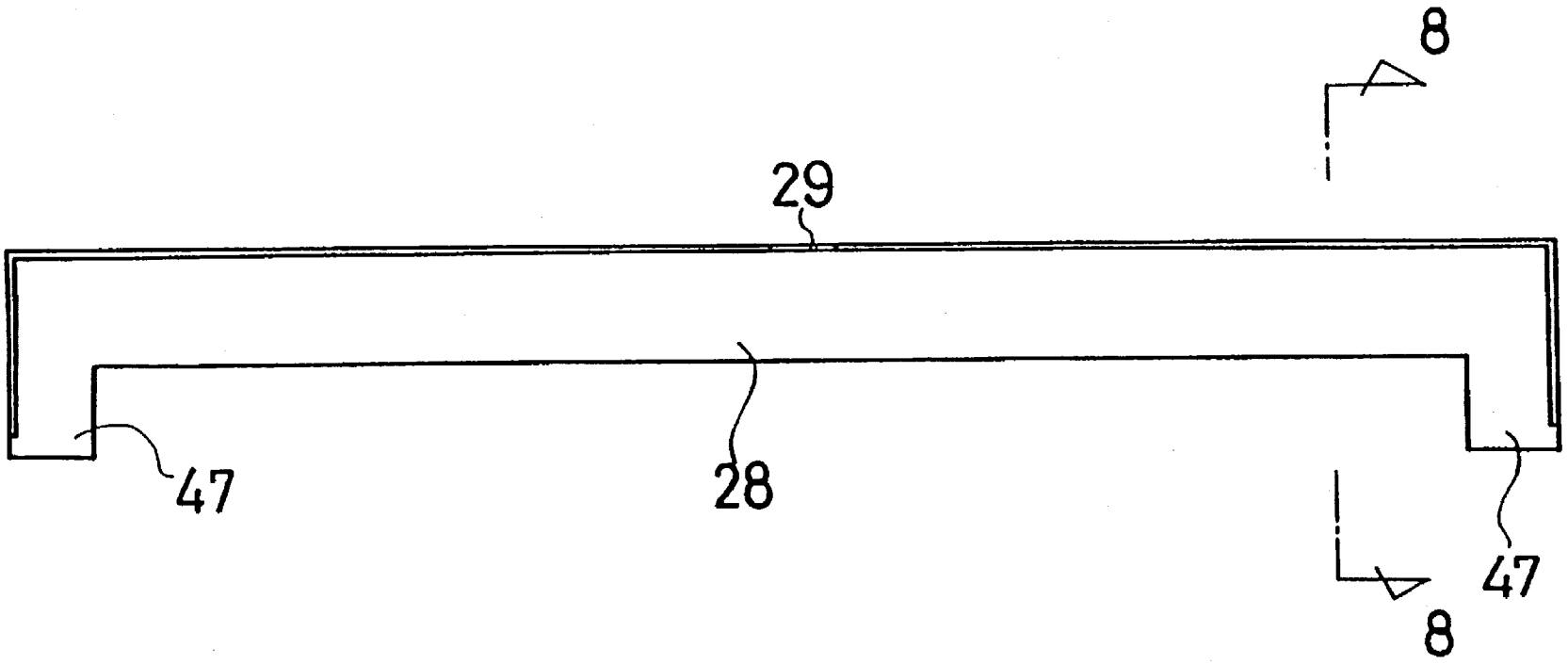
FIG. 7 is a plan view of the paper sheets positioning portion of FIG. 2.
Figure 8:
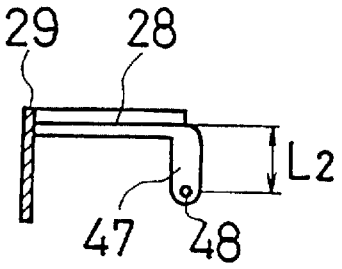
FIG. 8 is a vertical cross-sectional view along with 8–8 FIG. 7.
Figure 9:
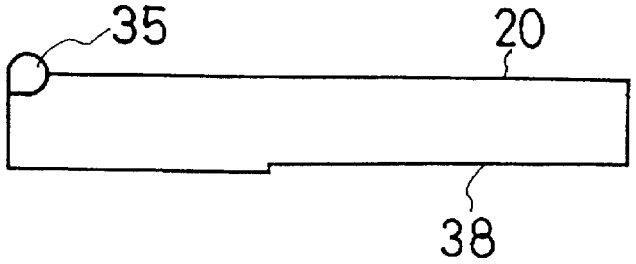
FIG. 9 is a side view of FIG. 4.
Figure 15:
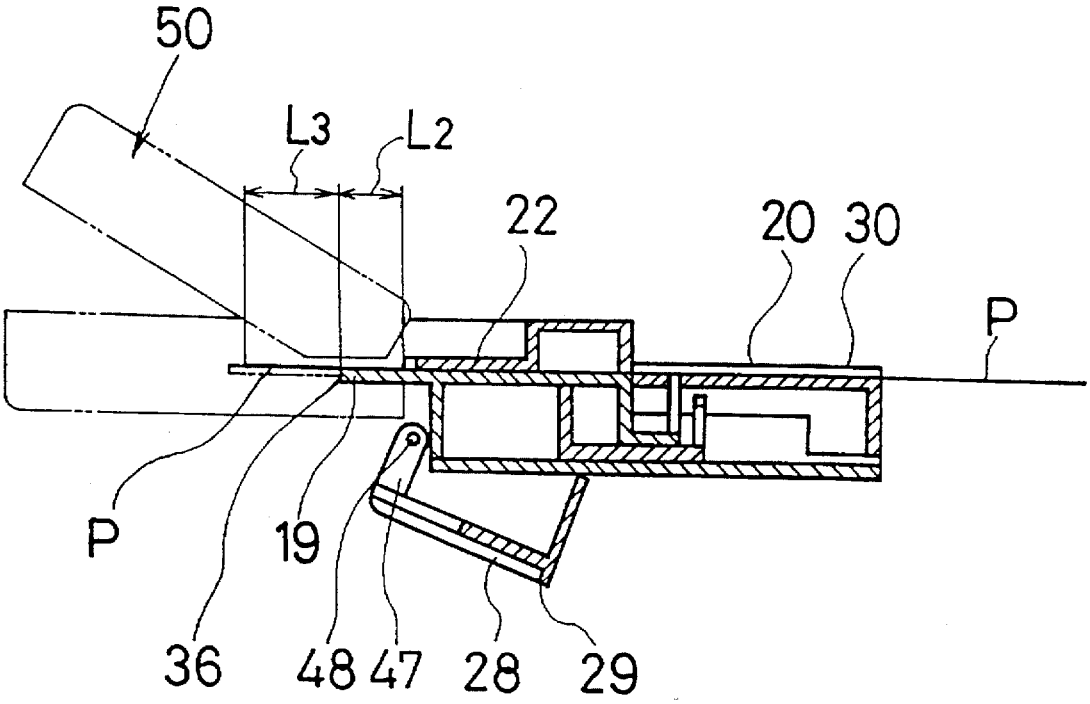
FIG. 15 is a vertical cross-sectional view along with 15—15 of FIG. 14.

Next, referring to FIG. 7 showing a plan view of the paper sheets positioning portion 28, it is explained. On both sides of the paper sheets positioning portion 28, bearing portion 47 are provided by being protruded. This bearing portion 47 is, as shown in FIG. 8 in cross-section along line 8—8, provided with a supporting portion 48 located at lower position by L2 from the upper surface of the paper sheets positioning portion 28. And around the supporting portion 48 the paper sheets positioning portion 28 is rotated, thereby it is retreated from the front edge 36 of the paper sheets placing portion 19 as shown in FIG. 15. And, the bearing portion 47 is adapted to be inserted in the cut-out portion 37 as shown in FIG. 4 and the supporting portion 48 is attached pivotally between the side of the guide portion 20 and the inner side of the cut-out portion 37. Further, it is noted that, in the state wherein the paper sheets positioning portion 28 is located adjacent to the front edge 36 of the paper sheets placing portion 19, the upper surface of the paper sheets placing portion 19 and the upper surface of the paper positioning portion 28 form one plane.

Further, when the paper sheets retaining plate 21 is closed as shown in FIG. 2, the punch guide portion 22 is adapted to be located adjacent to the upper surface of the paper sheets placing portion 19, whereby magnets 49 are provided on both of the back surface of the punch guide portion 22 and the opposite upper surface of the paper sheets placing portion in order to secure the paper sheets to be perforated. And, as shown in FIG. 15, when the paper sheets retaining plate 21 is closed, the front edge 36 of the paper sheets placing portion 19 is protruded from the punch guide portion 22 by L2 (FIG. 15).

The operation of the present invention thus formed is explained hereinafter. First, as to two functions to perforate the paper sheets P and open the ring binder, for perforating the paper P, referring to FIG. 2, in the state wherein the paper sheets positioning portion 28 is located adjacent to the front edge 36 of the paper sheets placing portion 19 and the cover 30 is closed, all of the upper surfaces of the paper sheets positioning portion 28, the paper sheets placing portion 19 and the cover 30 become one plane.

Subsequently, by opening the paper sheets retaining plate 21, the tip of the paper P is abutted against the raised portion 29 of the paper sheets positioning portion to determine the position of the paper P, then, by closing the paper retaining plate 21 the paper sheets are clamped between the punch guide portion 22 and the paper sheets placing portion 19, which is nipped fast by the magnets 49.

Next, since the paper sheets positioning portion 28 is attached pivotally to the guide portion 20, by turning it about the supporting portion 48 as shown in FIG. 15, the tip of the paper P is adapted to be in the state protruded from the front edge 36 of the paper sheets placing portion 19. At the same time, as shown in FIGS. 14 and 15, the punch positioning projection 51 of the punch for perforation 50 is brought into engagement with the punch positioning recess 23 to determine the position of the punch for perforation 50, and while sliding laterally on the front edge 36 of the punch guide portion 22 in a stable manner perforation of the punched holes P1 can be continuously carried out.

Thus, since, while the punch for perforation 50 is guided by the punch guide 22, the perforation of the paper P protruded from the front edge 36 of the paper placing portion 19 is carried out, the selection of the kind of the punch for perforation can vary the configuration of the holes perforated such as square or round upon the desire.

Subsequently, the operation for binding the paper P thus perforated by a ring binder 4 is explained.

First, the cover 30 is opened to expose the ring bars 25 and the L-ring bars 27. In that state, the ring bars and the L-ring bars come close or distant by opening or closing the paper sheets retaining plate 21 as previously explained.

And, in order to set the ring binder on the ring bars 25 and L-ring bars for opening the rings of the ring binder, the paper sheets retaining plate 21 is opened, thereby the ring bars 25 and the L-ring bars come close as shown in FIG. 12 and the base plate 201 of the ring binder 2 is engaged with the ring bars 25, then the ring binder 2 is shifted laterally a little to make the horizontally bent chips of the L-ring bars 27 be located in the rings 4. Subsequently, by closing the paper sheets retaining plate 21 the L-ring bars 27 come distant from the ring bars 25 to open the rings 4 as shown in FIG. 13.

Figure 13:
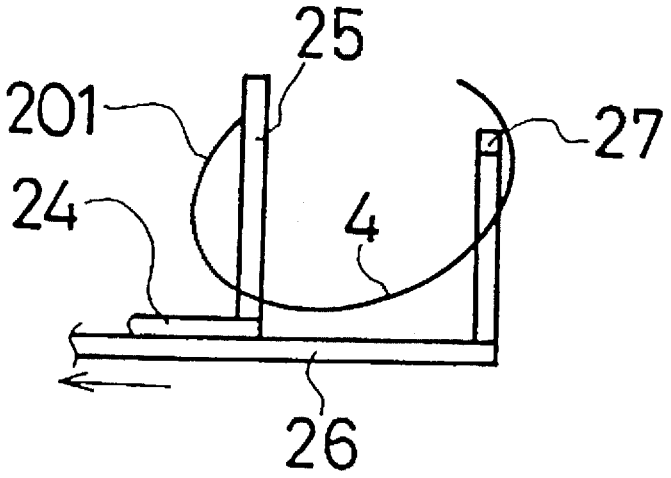
FIG. 13 is a side view when rings are opened.
Figure 16:
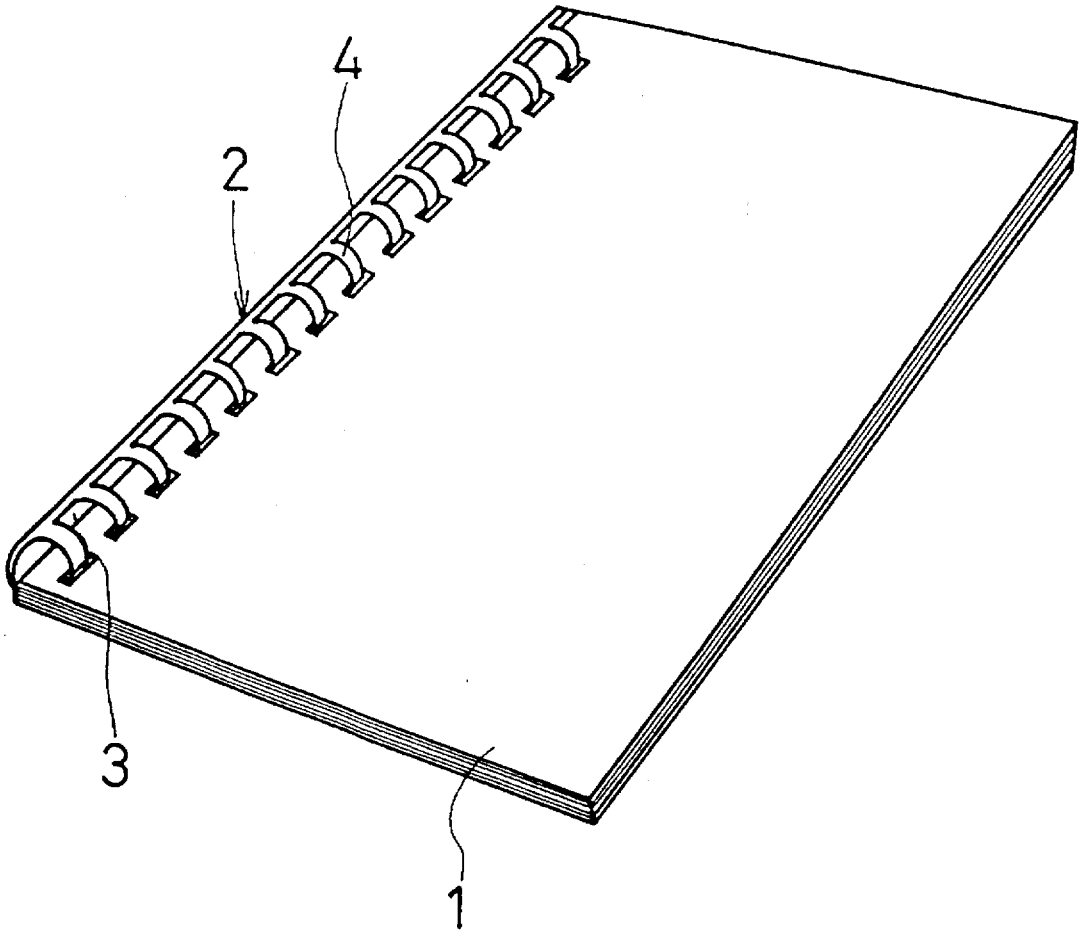
FIG. 16 is for explaining the state in which paper sheets are bound by a ring in prespective, FIG. 17 a perspective view of a conventional jig for perforation.
Figure 17:
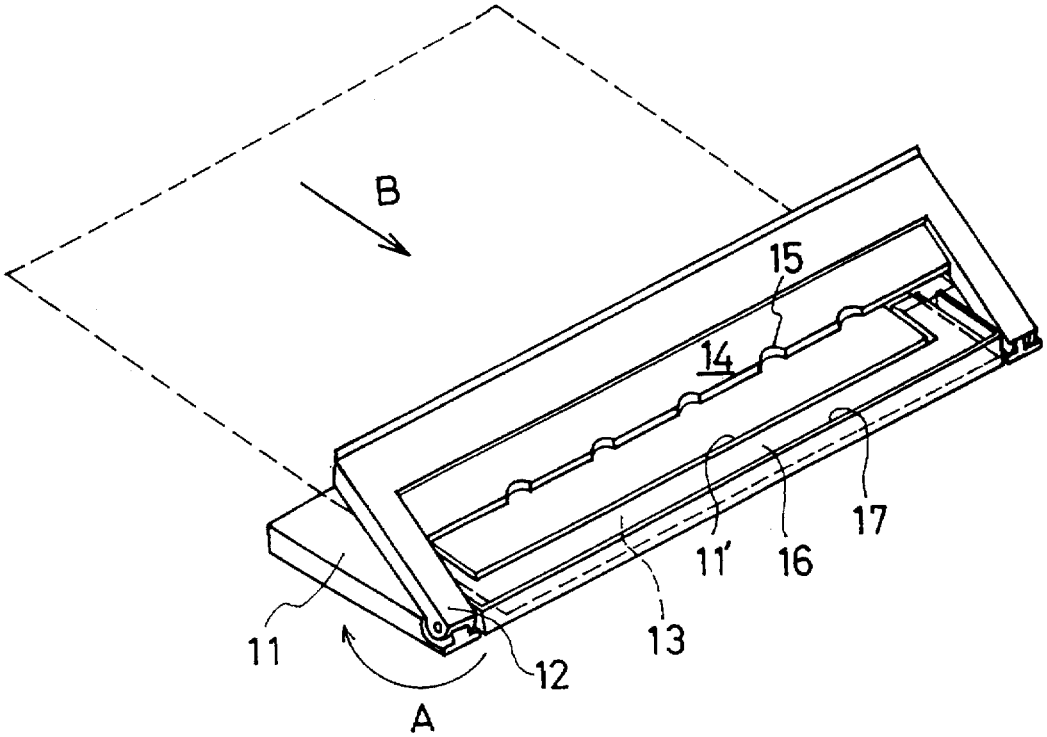
FIG. 17 (PRIOR ART)
Figure 18:
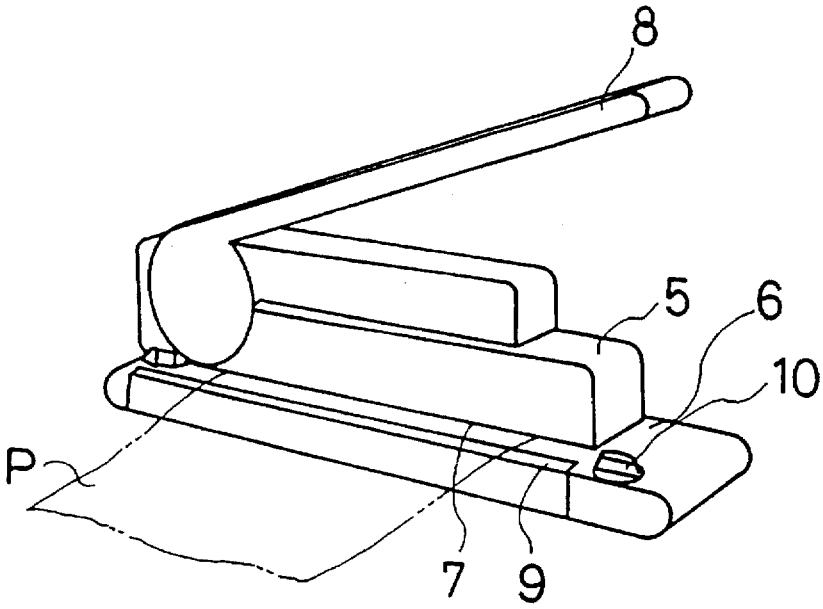
FIG. 18 (PRIOR ART)
FIG. 18 is a perspective view of a conventional ring binder with a perforator.

Thereafter, the tips 202 of the rings 4 opened as shown in FIG. 13 can be inserted into the rectangular openings of the paper P perforated in advance, then by opening the paper sheets retaining plate 21 the ring binder 2 returns to the state illustrated in FIG. 12, eventually the binding procedure is completed as shown in FIG. 16.

Finally, one issue to be raised and solved during the above procedures is explained as follows.

When the ring binder 2 is set in the state as shown in FIG. 12 and opened as shown in FIG. 13, the resilient force accumulated from plurality of rings is reached to some extent, thereby there is anxiety that the paper sheets retaining plate 21 is apt to return back from the closed position as shown in FIG. 2 to the opened position by releasing the hand. However, as shown in FIG. 1 obviously, the connection portion 46 of the rink 32 is adapted to be located below the line connecting between the pivot 35 and the connection stepped portion 44, so that the rink 32 is rather pushed resiliently onto the surface of the paper placing portion 19 in proportion to the total resilient force exerted from all rings 4.

In the jig of the present invention thus constructed, since the paper sheets positioning portion 28 (perforation side) is disposed adjacent to the flong edge 36 of the paper sheets placing portion 19 and on the stepped portion provided on the rear end of the paper sheets placing portion 19 the ring bars 25 (ring opening side) are planted, the perforation side (front side) and the ring opening side (rear side) are flush with each other to reduce the whole height.

Further, since the guide portions 20 are disposed on both sides of the paper placing portion 19, the paper sheets retaining plate 21, the paper sheets positioning portion and the cover 20 are attached pivotally thereto and the slider 33 is guided therein, the total structure is arranged in compact manner, and since the paper sheets retaining plate 21 attached pivotally to the end (perforation end of the paper sheets placing portion 19) of the guide portion 20 and the slider 33 are connected with a rink 32, the jig according to the present invention plays two functions, one of which is to clamp the paper sheets when perforating and the other one is to displace the L-ring bars when opening the rings of the ring binder.

What is claimed is:

1. Jig for perforating paper sheets and for binding said, perforated paper sheets comprising;

paper sheets placing portion having a stepped portion of L-letter in section on a rear end thereof, a pair of box type of guide portions provided in parallel on both sides of said paper sheets placing portion, paper sheets positioning portion attached pivotally to upper ends of said pair of guide portions and at its non-rotated position locating adjacent to a front edge of said paper sheets placing portion, paper sheets retaining plate attached pivotally to both ends of said guide portions locating at the front edge of the paper sheets placing portion, a punch guide portion provided integrally with said paper sheets retaining plate having an edge in parallel with said front edge and being provided with punch positioning recesses thereon Which are exposed when said paper sheets retaining plate is closed onto the paper sheets placing portion in such a manner as said edge is protruded, plural number of ring bars lined at regular spacing on said stepped portion, a movable plate disposed slidably beneath said stepped portion and provided with sliders on both ends thereof integrally which are guided in the guide portion, links connecting said sliders to the paper sheets retaining plate, and L-ring bars provided on a front edge of said movable plate in such a manner as those are lined in parallel with said ring bars at the same spacing with rings of a ring binder, and each with its tip end bent horizontally in the direction perpendicular to the sliding direction of the movable plate, wherein said paper sheets retaining plate is opened, and paper sheets positioned by the paper sheets positioning portion enable to be perforated with a punch along the punch guide portion by protruding said paper sheets from the front edge due to turning downward said paper positioning portion, and after perforating, by opening said paper sheets retaining plate, said ring bars and said L-ring bars come close, which enables the ring binder to be set on the ring bars and by closing said paper sheets retaining plate, said ring binder is opened to enable said rings to be inserted in the perforated holes of the paper sheets.

* * * * *